US005597226A

United States Patent [19]

Fast

[11] Patent Number: 5,597,226

[45] Date of Patent: Jan. 28, 1997

[54] METHOD AND AN ARRANGEMENT FOR ILLUMINATING FLAGS

[75] Inventor: Peder Fast, Kullavik, Sweden

[73] Assignee: Ultralux AB, Gotteborg, Sweden

[21] Appl. No.: 256,571

[22] PCT Filed: Jan. 28, 1993

[86] PCT No.: PCT/SE93/00060

§ 371 Date: Jul. 18, 1994

§ 102(e) Date: Jul. 18, 1994

[87] PCT Pub. No.: WO93/15494

PCT Pub. Date: Aug. 5, 1993

[30] Foreign Application Priority Data

Jan. 29, 1992 [SE] Sweden ..... 9200250

[51] Int. Cl.[6] ..... F21V 9/16

[52] U.S. Cl. ..... 362/84; 362/253; 362/812; 40/543; 116/173

[58] Field of Search ..... 362/84, 253, 260, 362/806, 812; 40/543, 603, 604, 610; 116/173, 174, 175

[56] References Cited

U.S. PATENT DOCUMENTS

| | | | |
|---|---|---|---|
| 2,652,650 | 9/1953 | Helms et al. | 40/543 |
| 2,793,453 | 5/1957 | Bixby | 40/610 |
| 2,887,983 | 5/1959 | Budd | 40/610 |
| 3,105,954 | 10/1963 | Gill, Jr. | 40/543 |
| 3,812,815 | 5/1974 | Kuenzel | 116/28 R |
| 3,923,001 | 12/1975 | Murdock | 116/173 |
| 4,234,907 | 11/1980 | Daniel | 362/32 |
| 4,744,012 | 5/1988 | Bergkvist | 362/84 |
| 4,991,537 | 2/1991 | Muramatsu | 362/84 |
| 5,043,193 | 8/1991 | Ueda | 362/84 |
| 5,307,251 | 4/1994 | Shaffer | 362/84 |

FOREIGN PATENT DOCUMENTS

| | | |
|---|---|---|
| 0029199 | 5/1981 | European Pat. Off. . |
| 840066 | 4/1939 | France . |
| 2629085 | 1/1978 | Germany . |
| 3638697 | 11/1991 | Germany . |
| 8602899 | 5/1986 | WIPO . |

*Primary Examiner*—Stephen F. Husar
*Attorney, Agent, or Firm*—Nies, Kurz, Bergert & Tamburro

[57] ABSTRACT

A method of illuminating flags raised on flagpoles, particularly advertising flags of the kind placed along roads and highways adjacent restaurants, hotels, and gasoline stations. One or more flags containing ultralight fluorescent material are illuminated by one or more lamps which transmit a significant proportion of ultraviolet light.

12 Claims, 1 Drawing Sheet

METHOD AND AN ARRANGEMENT FOR ILLUMINATING FLAGS

BACKGROUND OF THE INVENTION

The present invention relates to a method for illuminating flags.

Flags are used to a large extent in order to mark the presence of hotels, gasoline stations, restaurants, etc. It is often desired to amplify the effect produced, by mounting several flags adjacent to one another, often hoisted on relatively high flagpoles. The intention is to make the car driver aware of the presence of a gasoline station or pull-in in good time before the car driver reaches the facility concerned. These flags can be seen relatively easily in daylight. However, it is relatively common to illuminate flags with lamps during the darker hours.

The effect of this illumination, however, is limited, because the lamps have a relatively wide angle of spread and because the flag takes-up a relatively small area of the light cone of the light beam.

Thus, the problem is that the flags are not made visible to a sufficient extent, and are therefore not noticed to a sufficient degree during the dark hours of the day.

This problem is solved by the present invention.

SUMMARY OF THE INVENTION

Accordingly, the present invention relates to a method of illuminating flags that are raised on flagpoles, particularly flags which have an advertising character and which are placed along roads and highways to advertise restaurants, hotels and gasoline stations. The method is characterized in that one or more flags which include ultralight fluorescent material is/are illuminated by one or more lamps which transmit a considerable proportion of ultraviolet light.

The invention also relates to an arrangement for illuminating flags raised on flagpoles, particularly advertisement flags of the kind placed along roads and highways adjacent restaurants, hotels, and gasoline stations. One or more flags are provided that include an ultralight fluorescent material, and one or more lamps are provided for illuminating the flags. The lamps are located in spaced relationship relative to the respective flags and are constructed to transmit a significant proportion of ultraviolet light.

BRIEF DESCRIPTION OF THE DRAWING

The invention will now be described in more detail with reference to an exemplifying embodiment thereof and also with reference to the accompanying drawing, the single FIGURE of which illustrates an illuminated flag.

DESCRIPTION OF THE PREFERRED EMBODIMENTS

Figure 1:
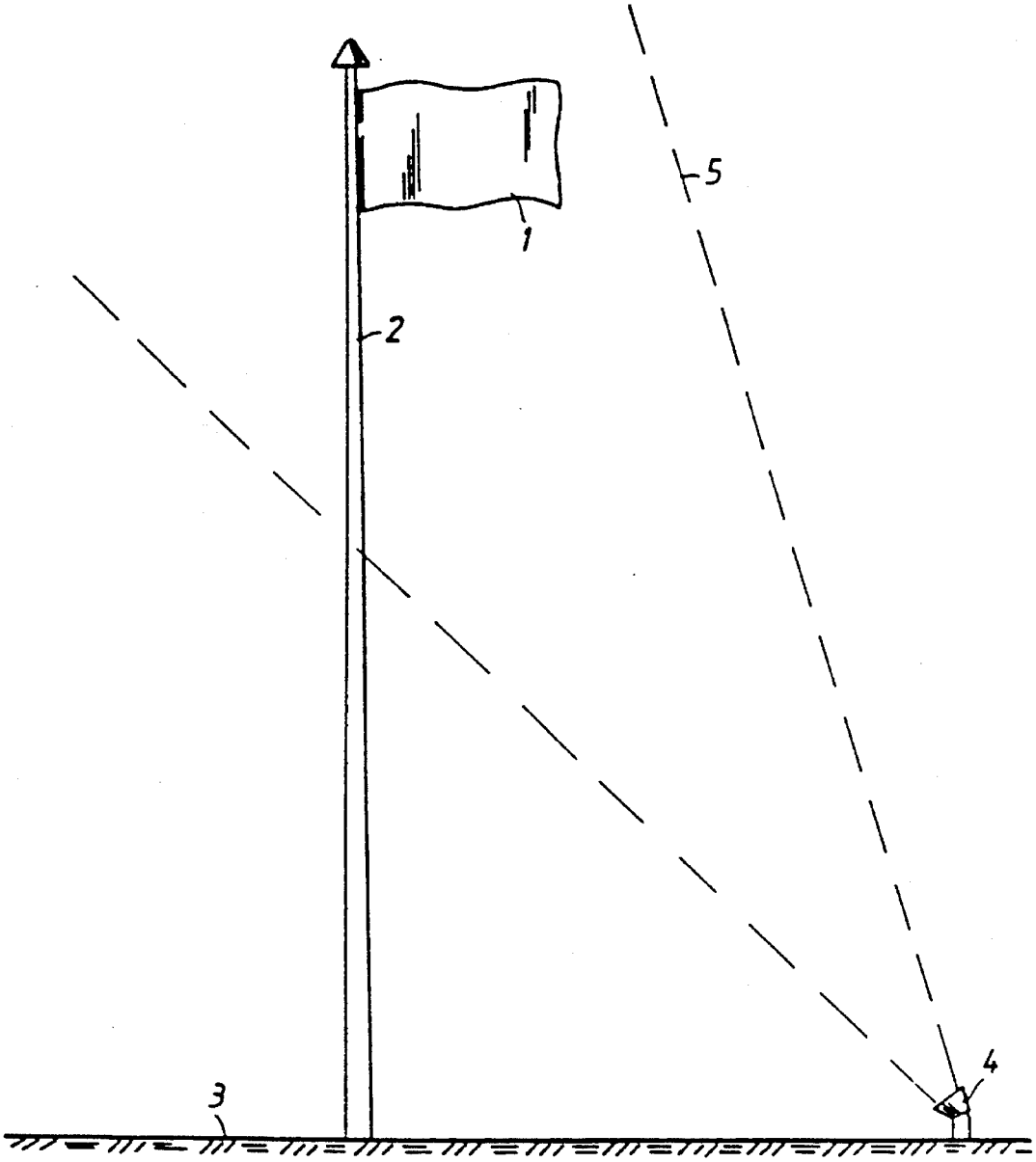

The drawing illustrative of the present invention illustrates a flag 1 which is raised on a flagpole 2 standing on the ground 3. The flags referred to are particularly of the kind which carry an advertisement and which are placed along roads in the neighbourhood of restaurants, hotels and gasoline stations. By advertisement is meant an emblem, a trademark, a so-called logotype, a name or the like which distinguishes or characterizes the facility at which the flag is raised, for instance a gasoline station or a restaurant available to the traveller.

However, the invention is not limited to flags which are erected along roads in the meaning of country roads, but can be applied to any flag which it is desired to illuminate during the dark hours.

According to the present method, one or more flags which include ultralight fluorescent material is/are illuminated by means of one or more lamps 4 which transmit a significant proportion of ultraviolet light. The lamps 4 are placed suitably on the ground, although they may also be placed on nearby buildings, so as to protect the fittings from damage, among other things.

Alternatively, the lamps may be mounted somewhat along the flagpole and be directed upwardly, or may be mounted at or close to the top of the flagpole and be directed downwards.

The lamps may suitably be of the kind which use a mercury bulb as a light source, this bulb coacting with a reflector in a manner to form a light cone 5 which is directed onto the flag or flags. The light cone 5 is shown in the drawing in broken lines. A further aspect of the invention pertains to providing the lamp or lamps located spaced apart and away from the respective flag and if desired from the pole, although the lamp or lamps can be located on the pole spaced away from the flag.

It has surprisingly been found that when illuminating such flags with a lamp that transmits ultraviolet light, these known flags will fluoresce with an effect that is seldom achieved in the dark. The effect obtained is incomparably better than when flags are illuminated in a corresponding manner by means of solely visible light.

Mercury lamps transmit both ultraviolet light and visible light. Thus, the flag and the flagpole are illuminated with visible light in addition to ultraviolet light.

According to one preferred embodiment of the invention, the lamp includes a filter which functions to filter-out visible light. One suitable filter in this regard is a so-called Wood's glass filter, which is placed, for instance, in the light aperture of the lamp. When the light is filtered, the flagpole will not be illuminated with visible light, and hence only the flag will be illuminated. This provides an extremely noticeable effect with regard to the appearance of the flag, which seems to be freely suspended in air, so to speak.

According to one embodiment of the invention, the flags are provided with pigment which fluoresces when irradiated with ultraviolet light. This will naturally increase the fluorescence effect.

According to another embodiment, the flags are comprised totally or partially of synthetic fibre material and possess good fluorescent properties when irradiated with ultraviolet light. Fluorescent substances may also be added to the flag material in the manufacture of said material, in order to enhance the fluorescence effect.

According to another embodiment, an emblem, trademark or corresponding symbol on the flags is comprised of a material which provides much stronger fluorescence than the remainder of the flags. This results in a pronounced advertising effect.

The present invention can be practiced with ultraviolet lamps other than those aforementioned. Furthermore, any suitable fluorescent material can be used.

The invention shall not therefore be considered restricted to the afore-described embodiments, since modifications and changes can be made within the scope of the following claims.

I claim:

1. A method for illuminating flags, and particularly advertising flags which are placed along roads and highways in the neighborhood or restaurants, hotels and gasoline stations, said method comprising: providing a flag including ultralight fluorescent material; raising the flag on a flagpole; and illuminating the flag with a lamp located separate from and spaced apart from the flag, wherein the lamp emits light that includes a significant proportion of ultraviolet light.

2. A method according to claim 1, including the step of providing a filter in the path of light emitted by the lamp for filtering-out visible light.

3. A method according to claim 1, including the step of providing on the flag a pigment which fluoresces when irradiated with ultraviolet light.

4. A method according to claim 1, including the step of producing the flag from a material that includes synthetic material which fluoresces when irradiated with ultraviolet light.

5. A method according to claim 4, including the step of providing indicia on the flag, wherein the indicia are defined by a material which provides greater fluorescence than the remainder of the flag.

6. A method according to claim 1 wherein the lamp is a mercury lamp.

7. An arrangement for illuminating flags raised on flagpoles, particularly advertisement flags of the kind placed along roads and highways adjacent restaurants, hotels and gasoline stations, said arrangement comprising: a flag that includes an ultralight fluorescent material; a lamp for illuminating the flag, said lamp located separate from and spaced apart from the flag, wherein the lamp emits light that includes a significant proportion of ultraviolet light.

8. An arrangement according to claim 7, wherein the lamp includes a filter which filters-out visible light.

9. An arrangement according to claim 7, wherein the flag includes a pigment which will fluoresce when irradiated with ultraviolet light.

10. An arrangement according to claim 7, wherein the flag is made from a synthetic fibre material which will fluoresce when irradiated with ultraviolet light.

11. An arrangement according to claim 10, wherein indicia are carried by the flag and the indicia are defined by a material which will fluoresce more than the remainder of the flags.

12. An arrangement according to claim 7 wherein the lamp is a mercury lamp.

* * * * *